US007467844B2

(12) United States Patent
Matsumoto

(10) Patent No.: US 7,467,844 B2
(45) Date of Patent: Dec. 23, 2008

(54) LIQUID EJECTION APPARATUS AND METHOD OF CONTROLLING LIQUID EJECTION APPARATUS

(75) Inventor: Keiji Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 238 days.

(21) Appl. No.: 11/331,130

(22) Filed: Jan. 13, 2006

(65) Prior Publication Data

US 2006/0152544 A1 Jul. 13, 2006

(30) Foreign Application Priority Data

Jan. 13, 2005 (JP) ..... P2005-006016
Dec. 13, 2005 (JP) ..... P2005-358578

(51) Int. Cl.
*B41J 2/165* (2006.01)

(52) U.S. Cl. ..... 347/22; 347/35

(58) Field of Classification Search ..... None
See application file for complete search history.

(56) References Cited

U.S. PATENT DOCUMENTS

| | | | | |
|---|---|---|---|---|
| 6,042,218 | A * | 3/2000 | Nakahara | 347/35 |
| 6,189,997 | B1 | 2/2001 | Kanome et al. | |
| 7,121,652 | B2 * | 10/2006 | Harada et al. | 347/85 |
| 2005/0078144 | A1 * | 4/2005 | Yamada et al. | 347/30 |
| 2005/0252062 | A1 * | 11/2005 | Scrogin et al. | 42/119 |

FOREIGN PATENT DOCUMENTS

| | | | |
|---|---|---|---|
| EP | 1 000 743 | A2 | 5/2000 |
| EP | 1 270 234 | A1 | 1/2003 |
| JP | 10-226090 | A | 8/1998 |
| JP | 2001-191557 | A | 7/2001 |

OTHER PUBLICATIONS

European Search Report dated Jul. 5, 2006.

* cited by examiner

*Primary Examiner*—Matthew Luu
*Assistant Examiner*—Justin Seo
(74) *Attorney, Agent, or Firm*—Sughrue Mion, PLLC

(57) ABSTRACT

A liquid ejection apparatus comprising: a liquid ejection head, operable to eject liquid to a target; a printing region, at which the liquid ejection head ejects liquid to the target; a flushing region, at which the liquid ejection head ejects liquid to perform a flushing operation; a flushing receiver, provided at the flushing region and adapted to receive liquid ejected from the liquid ejection head at the flushing region; a liquid ejection head carrier, operable to carry the liquid ejection head at least between the printing region and the flushing region; a waiting time information generator, operable to generate a waiting time based on estimation information to estimate a time in which liquid ejected from the liquid ejection head arrives at the flushing receiver; and a controller, operable to control the liquid ejection head carrier to carry the liquid ejection head from the flushing region toward the printing region after the waiting time elapses.

10 Claims, 9 Drawing Sheets

FIG. 7

| DOT LANDING CAPABILITY (P) | DOT WEIGHT (ng) | INITIAL DOT VELOCITY (m/s) |
|---|---|---|
| 5.0 | 2.0 | 2.5 |
| 10.0 | 2.0 | 5.0 |
| 15.0 | 3.0 | 5.0 |
| 20.0 | 4.0 | 5.0 |

LIQUID EJECTION APPARATUS AND METHOD OF CONTROLLING LIQUID EJECTION APPARATUS

TECHNICAL FIELD OF THE INVENTION

The present invention relates to a liquid ejection apparatus which ejects liquid towards a target and a control method of a liquid ejection head.

BACKGROUND OF THE INVENTION

In the related art, in a liquid ejection apparatus such as an inkjet recording apparatus, an inkjet recording head is equipped. In this inkjet recording head, a large number of nozzles that act to eject ink onto a recording paper and the like are arranged.

However, the ink which the inkjet recording head ejects, which contains an ink solvent, has various problems causing inferior printing due to the rise of ink viscosity caused by the evaporation of the ink solvent and ink solidification, and further, by dust deposition, and, still further, by bubble contamination.

To solve such problems, the inkjet recording apparatus is configured so as to perform flushing operation (For example, see Japanese Patent Laid-open No. 2001-191557, hereinafter referred to as JPA '557).

Namely, the inkjet recording apparatus is configured so as to provide a flushing portion in the portion where no recording paper is present, and for the inkjet recording head to eject ink to this region to prevent ink viscosity from rising.

Specifically, the inkjet recording head moves from a printing region where recording paper is placed to the flushing portion in case when flushing operation is required.

This movement is conducted by the moving of the carriage on which the inkjet recording head is mounted.

The apparatus is configured so that the inkjet recording head, after completion of flushing operation, immediately moves to the printing region for recording via the movement of the carriage.

FIG. 9 is a schematic explanatory drawing illustrating the relationship of a related art inkjet recording head 10 and a flushing portion 11. As shown in FIG. 9, between the inkjet recording head 10 and the flushing portion 11, a gap L is formed.

Thus, the ink ejected from the inkjet recording head 10 reaches the flushing portion 11 after elapse of a predetermined period.

In such operation, if the inkjet head 10 moves before the ejected ink reaches the flushing portion 11, the ink that failed in surely reaching the flushing portion 11 by following the change in air stream caused by this head movement scatters within the inkjet recording apparatus, acting as a source of mist formation.

Such mist has caused a trouble of, in addition to recording paper soiling, contaminating the inside and outside of the inkjet recording apparatus.

To solve such troubles, a configuration is proposed in which a fan arranged in the flushing box that conducts flushing collects the mist (For example, see JPA '557).

However, the configuration shown in JPA '557 has had a problem that since the configuration makes a bulky apparatus, it can be adopted only in a large-size inkjet recording apparatus.

Alternately, it is possible, without adopting such a configuration, to move the inkjet recording head after waiting for a sufficiently long period until the ink from the inkjet recording head 10 completely reaches the flushing portion 11.

However, when in such a manner the inkjet recording head 10 is moved to the printing region along after securing a sufficient waiting time, there arises another problem of deterioration of printing throughput.

Moreover, it is assumed that the period that the mist reaches the flushing portion 11 from the inkjet recording head 10 varies depending on various conditions. But there has been a problem that it is not clear under what condition the period varies.

SUMMARY OF THE INVENTION

Accordingly, an embodiment of the invention has an object of providing a liquid ejection apparatus as well as a method of controlling a liquid ejection apparatus which not only suppresses mist generation to a sufficient degree during flushing operation but also can set a waiting period under a desirable condition without deteriorating printing throughput.

The above-mentioned object can be achieved, according to an embodiment of the invention, by a liquid ejection apparatus comprising a target-arranging portion that arranges a target; a liquid ejection head that ejects liquid to the target; a flushing portion in which the liquid ejection head ejects the liquid for flushing; and a liquid ejection head carrier that moves the liquid ejection head at least between the target-arranging portion and the flushing portion; characterized by that the apparatus has a waiting time information generator that generates waiting time information based on the estimation information to estimate the time in which the liquid reaches the flushing portion, and that the apparatus is configured so that, at the flushing operation, the liquid ejection head carrier moves the liquid ejection head based on the waiting time information.

According to the above-cited configuration, since the apparatus has a waiting time information generator that generates waiting time information based on the estimation information to estimate the time that the liquid reaches the flushing portion, it is possible to accurately estimate the time that the liquid reaches the distance between the liquid ejection head and the flushing portion in the liquid ejection apparatus.

Moreover, the liquid ejection head carrier of the liquid ejection apparatus moves the liquid ejection head based on this waiting time information.

Namely, the liquid ejection head carrier moves the liquid ejection head after waiting for the waiting time that is the period required for the liquid ejected from the liquid ejection head to reach the flushing portion.

With such a configuration, since the liquid ejection head carrier does not move until the liquid ejected from the liquid ejection head reaches the flushing portion, mist generation can be prevented beforehand, thus preventing contamination of the inside as well as the outside of the liquid ejection apparatus.

Further, since the waiting time information is generated based on the estimation information between the liquid ejection head and the flushing portion and the estimation information is differently set depending on each liquid ejection apparatus, waiting time information suited to each liquid ejection apparatus can be individually formed.

Thus, since, compared with the case where the waiting time is indiscriminately set, time for useless waiting can be avoided, a waiting time can be set in an appropriate condition without deteriorating printing throughput.

Preferably, in the apparatus of the invention, estimation information may be the information on the velocity with which the liquid is ejected from the liquid ejection head.

According to the configuration, the waiting time information is formed based on the velocity information when the liquid is ejected from the liquid ejection head. In other words, if the liquid velocity is small, it takes a long time for the liquid to reach the flushing portion, while, inversely, if the velocity is large, the time becomes short. Namely, by establishing the waiting time based on the velocity information, one can estimate the time until the liquid reaches the flushing portion. And, since, during this estimated time, the liquid ejection head is not moved, mist diffusion can be preferably prevented.

In addition, since the estimation information is singular information, information acquisition is easy and it does not need taking too much time for condition setting, and the information can be processed quickly.

Preferably, in the apparatus of the invention, the estimation information may be the information on the weight of the liquid.

According to the configuration, the waiting time information is formed based on the information on the weight of the liquid. In other words, the smaller the liquid weight is, the longer reaching time is required since the velocity with which the liquid reaches the flushing portion is likely to fall. Namely, by establishing the waiting time based on the information of the weight of the liquid, one can estimate the time until the liquid reaches the flushing portion. And, since, during this estimated time, the liquid ejection head is not moved, mist diffusion can be preferably prevented.

In addition, since the estimation information is singular information, information acquisition is easy, it does not need taking too much time for condition setting, and the information can be processed quickly.

Preferably, in the apparatus of the invention, the estimation information may be the information on the distance between the liquid ejection head and the flushing portion.

According to the configuration, the waiting time information is generated based on the information on the distance between the liquid ejection head and the flushing portion. In other words, the longer the distance between the liquid ejection head and the flushing portion is, the more it takes for the liquid to reach the flushing portion.

Namely, by establishing the waiting time based on the information on the distance between the liquid ejection head and the flushing portion, one can estimate the time until the liquid reaches the flushing portion. And, since, during this estimated time, the liquid ejection head is not moved, mist diffusion can be preferably prevented.

In addition, since the estimation information is singular information, information acquisition is easy, it does not need taking too much time for condition setting, and the information can be processed quickly.

Preferably, in the apparatus of the invention, the estimation information may be the information on the accumulated printing time obtained by accumulating the printing time during which the liquid ejection head ejects the liquid towards the target.

According to the configuration, the waiting time information is generated based on the information on the accumulated printing time obtained by accumulating the printing time during which the liquid ejection head ejects the liquid towards the target. In other words, the longer the accumulated printing time is, the liquid in the nozzle part of the liquid ejection head increases its viscosity to decrease velocity. And, as a result, it takes a long time for the liquid to reach the flushing portion.

Namely, by establishing the waiting time based on the information on the accumulated printing time obtained by accumulating the printing period during which the liquid ejection head ejects the liquid towards the target, one can estimate the time until the liquid reaches the flushing portion. And, since, during this estimated time, the liquid ejection head is not moved, mist diffusion can be preferably prevented.

In addition, since the estimation information is singular information, information acquisition is easy and it does not need taking too much time for condition setting whereby the information can be processed quickly.

Preferably, in the apparatus of the invention, the estimation information may be the information on the liquid species related to the specific gravity or viscosity of the liquid.

According to the configuration, the waiting time information is generated based on the information on the liquid species related to the specific gravity or viscosity of the liquid. In other words, the larger the specific gravity or viscosity of the liquid is, the smaller becomes the velocity with which the liquid reaches the flushing portion.

Namely, by establishing the waiting time based on the information on the liquid species related to the specific gravity or viscosity of the liquid, one can estimate the time until the liquid reaches the flushing portion. And, since, during this estimated time, the liquid ejection head is not moved, mist diffusion can be preferably prevented.

In addition, since the estimation information is singular information, information acquisition is easy and it does not need taking too much time for condition setting, and the information can be processed quickly.

Preferably, in the apparatus of the invention, the estimation information is the combined information which is obtained by combining a plurality of information among the information on the velocity with which the liquid is ejected from the liquid ejection head, the information on the weight of the liquid, the information on the distance between the liquid ejection head and the flushing portion, the information on the accumulated printing period obtained by accumulating the printing time during which the liquid ejection head ejects the liquid towards the target, and the information on the liquid species related to the specific gravity or viscosity of the liquid.

According to the configuration, the waiting time information is generated based on the combined information which is obtained by combining a plurality of information among the velocity information, weight information, distance information, accumulated printing time information, and the liquid species information. Thus, more accurate waiting time information can be formed.

Preferably, in the apparatus of the invention, the estimation information may be the information on the velocity with which the liquid is ejected from the liquid ejection head, the information on the weight of the liquid, and the information on the distance between the liquid ejection head and the flushing portion, and the apparatus may have: a liquid reaching capability information generator that generates information on the liquid reaching capability based on the velocity information and the weight information; and a waiting time information generator that generates information on the waiting time based on the length information and the liquid reaching capability information, and the apparatus is configured so that, the liquid ejection head carrier moves the liquid ejection head based on the waiting time information.

According to the configuration, the apparatus of the invention has the liquid reaching capability information generator that generates the liquid reaching capability based on the liquid velocity information and the liquid weight information.

And, by the information on the liquid reaching capability thus generated, the liquid ejection apparatus can acquire the information on the landing capability such as the velocity with which the liquid reaches the flushing portion and the like.

Further, the liquid ejection apparatus has the waiting time information generator that generates information on the waiting time information based on this liquid reaching capability information, and the information on the distance between the liquid ejection head and the flushing portion. Since this waiting time information additionally takes into account the information on the distance between the liquid ejection head and the flushing portion and the liquid reaching capability information, the distance between the liquid ejection head and the flushing portion in the liquid ejection apparatus is taken into consideration.

For that reason, an accurate estimation of the time for the liquid to reach the distance between the liquid ejection head and the flushing portion in the liquid ejection apparatus is possible.

The liquid ejection head carrier of the liquid ejection apparatus moves the liquid ejection head according to this waiting time information.

Namely, the liquid ejection head carrier moves the liquid ejection head after waiting for the waiting time which is the period required for the liquid ejected from the liquid ejection head to reach the flushing portion.

With such a configuration, since the liquid ejection head carrier does not move until the liquid ejected from the liquid ejection head reaches the flushing portion, mist generation can be prevented beforehand, thus preventing contamination of the inside as well as the outside of the liquid ejection apparatus.

Further, since the waiting time information is generated based on the distance information between the liquid ejection head and the flushing portion and the information is differently set for each liquid ejection apparatus, waiting time information suited to each liquid ejection apparatus is individually generated.

Thus, since, compared with the case where the waiting time is set to be constant, useless waiting time can be avoided, a waiting time can be set in an appropriate condition without deteriorating printing throughput.

Preferably, in the apparatus of the invention, the information on the liquid velocity is the information on the initial dot velocity with which a liquid dot is ejected from the liquid ejection head.

Preferably, in the apparatus of the invention, the information on the liquid weight is the information on the weight of a liquid dot.

According to the configuration, the information on the liquid velocity is the information on the initial dot velocity with which a liquid dot is ejected from the liquid ejection head.

Since, these kinds of information are easily available, liquid reaching capability information and waiting time information can be comparatively readily generated with use of these kinds of information.

Thus, without using an apparatus with a complicated structure, a liquid ejection apparatus with a simple structure can be attained which can prevent mist generation beforehand and further deterioration of printing throughput.

The object can also be achieved, according to the invention, by a method of controlling a liquid ejection apparatus comprising a target-arranging portion that arranges a target; a liquid ejection head that ejects liquid to the target; a flushing portion in which the liquid ejection head ejects the liquid for flushing; and a liquid ejection head carrier that moves the liquid ejection head at least between the target-arranging portion and the flushing portion; wherein the controlling method contains a step of generating information on liquid reaching capability based on the liquid weight information and the information on the velocity with which the liquid is ejected from the liquid ejection head, a step of generating information on the waiting time information based on the information on the distance between the liquid ejection head and the flushing portion and the liquid reaching capability information, and a step of moving the liquid ejection head by the liquid ejection head carrier based on the waiting time information.

BRIEF DESCRIPTION OF THE DRAWINGS

FIG. 7 is an example of the data showing the results of calculating dot landing capability (P) data;

DETAILED DESCRIPTION OF THE INVENTION

In the following, embodiments of this invention will be described in detail with reference to the attached drawings.

By way of precaution, though the embodiments to be described hereinbelow, which include various technically preferable limitations as they are appropriate specific examples of the invention, the scope of the invention should not be limited to these embodiments at all so long as there is no specific statement that some limitation restricts the invention.

Figure 1:
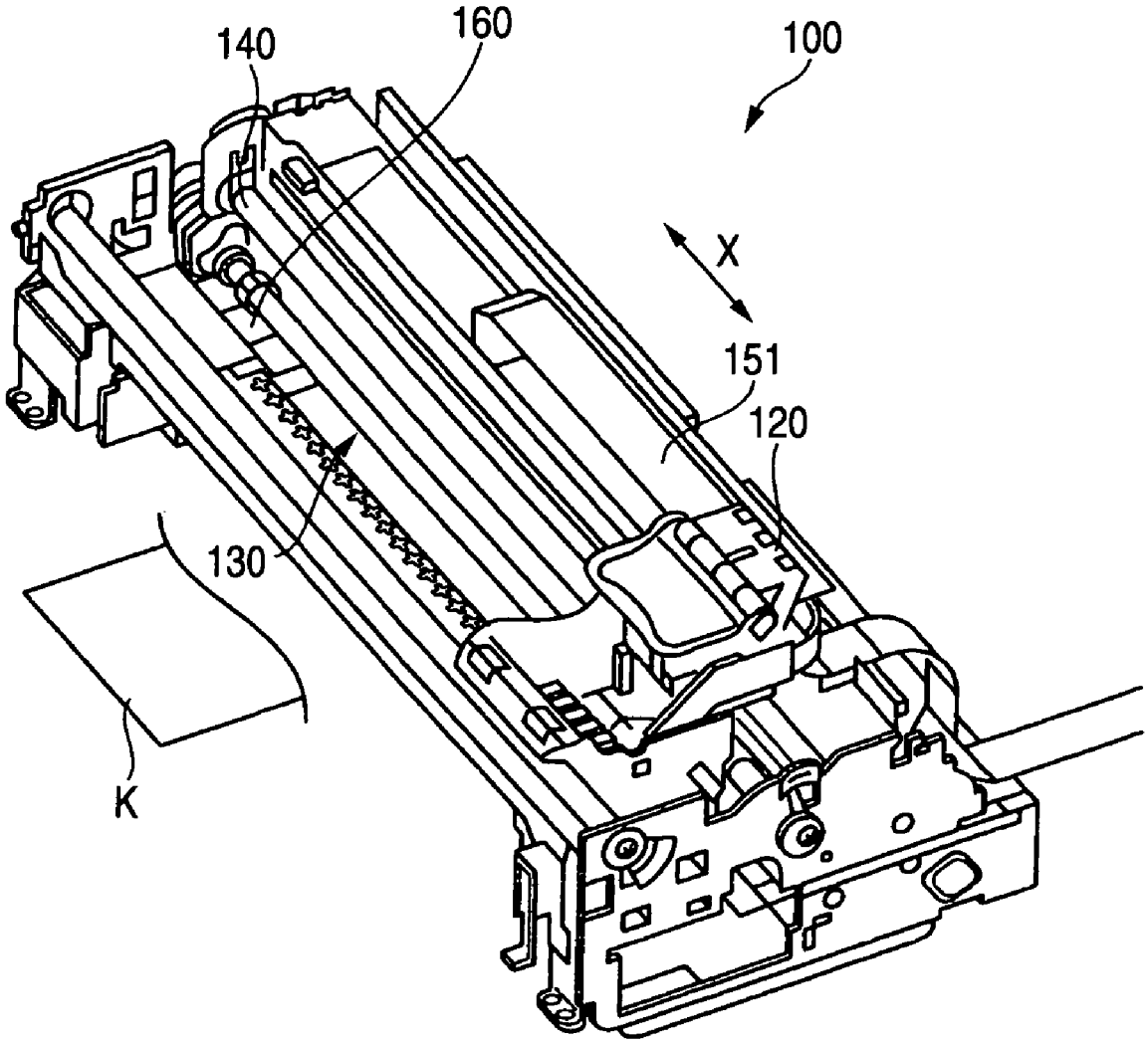
FIG. 1 is an outlined perspective diagram illustrating an inkjet recording apparatus according to one embodiment of the liquid ejection apparatus of the invention.
Figure 2:
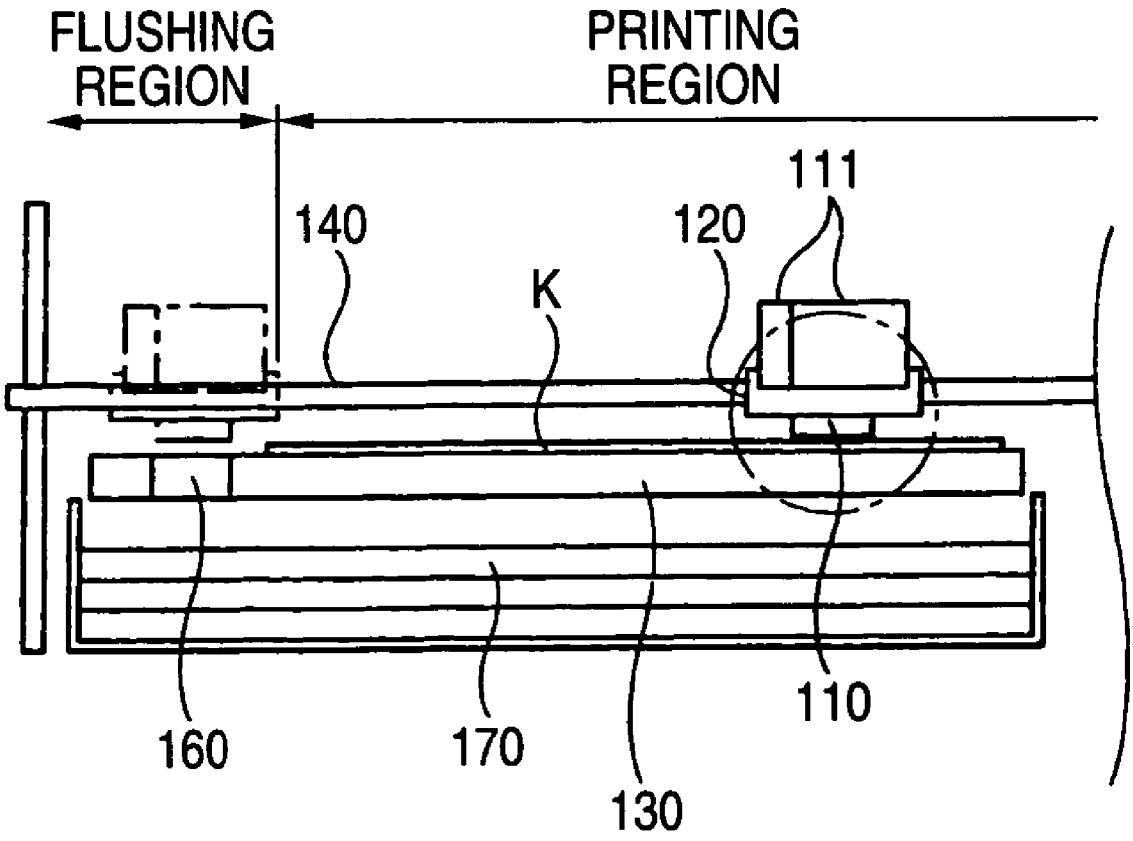
FIG. 2 is an outlined explanatory diagram showing the operating state of the recording apparatus.

FIG. 1 is an outlined perspective view of an inkjet recording apparatus (referred to as 'recording apparatus' hereinafter) 100 associated with an embodiment of the liquid ejection apparatus according to the invention. FIG. 2 is an outlined explanatory drawing illustrating the operational state of the recording apparatus 100.

As shown in FIG. 1, the recording apparatus 100 has a target-arranging portion, exemplified by a platen 130, which arranges a target exemplified by a piece of recording paper K.

The recording apparatus 100 also has a liquid ejection head, exemplified by an inkjet recording head 110 (referred to as 'recording head' hereinafter), which ejects liquid, exemplified by ink, towards the recording paper K (Refer to FIG. 2).

Further, the recording apparatus 100 has a carriage 120 to accommodate the recording head 110, and the carriage 120 is constituted so as to be movable in the direction X shown by an arrow along a guiding axis 140 in FIG. 1 by means of a liquid ejection head carrier, exemplified by a carriage motor 150 (to be described later) and a timing belt 151.

As shown in FIG. 1, in the recording apparatus 100, a flushing portion 160 on which the recording head 110 ejects ink for flushing is provided. In the specification, the flushing portion 160 has two meanings. One is a position of the recording head 110 at which the recording head 110 ejects liquid to perform a flushing operation. The position may be referred to as a flushing region. The other is a receiver adapted to receive liquid ejected from the liquid ejection head at the flushing region. The receiver may be refereed to as a flushing receiver.

Here, flushing is explained. The ink to be ejected from the recording head 110 contains an ink solvent and various ingredients. Since this ink solvent evaporates with elapse of time, there is a possibility that the recording head 110 is choked due to viscosity increase of the ink. Therefore, the recording head 110 conducts a flushing operation for ejecting the ink towards a flushing portion 160 which is different from the recording paper K with a constant periodical interval to prevent the viscosity increase of ink beforehand.

Since such a flushing portion 160 and the printing region where printing is carried out on the recording paper K are both arranged along a guiding axis 140, the apparatus is configured so that the recording head can move between the printing region and the flushing portion 160 by moving the carriage 120 along the guiding axis 140.

Such a movement of the recording head 110 is shown in FIG. 2. As shown in FIG. 2, on the recording head 110 arranged in the carriage 120, an ink cartridge 111 accommodating ink is arranged.

The recording head 110 is configured so as to be movable between the printing region where the recording paper K is placed and the flushing region, as stated above, and further so that the ink ejected form the recording head 110 at the flushing portion 160 is absorbed by a waste liquid-absorbing material 170.

Figure 3:
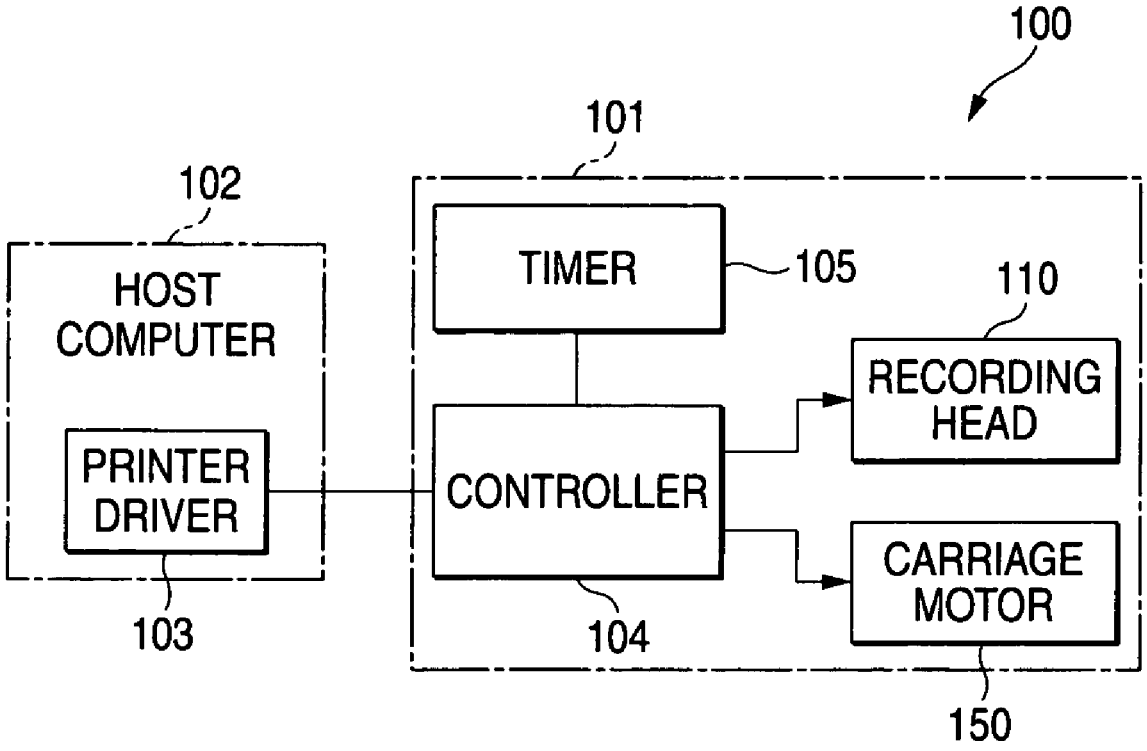
FIG. 3 is an outlined block diagram showing the main configuration of the recording apparatus in FIG. 1.

FIG. 3 is an outlined block diagram showing the main configuration of the recording apparatus 100 in FIG. 1. As shown in FIG. 3, the recording apparatus 100 has an apparatus main body 101 and a host computer 102.

The apparatus main body 101 has a controller 104, and the host computer 102 has a printer driver 103. The controller 104 is connected to the host computer 102 via a local printer cable or a communication network.

Further, the controller 104 is configured so as to be connected to a timer 105 and to the recording head 110, the carriage motor 150, etc., too, thus controlling their operations.

Moreover, the printer driver 103 has software that sends commands to drive the recording head 110 and the carriage motor 150. Namely, the printer driver is so constructed that, by the indication of the printer driver 103, the carriage 120 in FIG. 1 moves to the printing position for the recording paper K in FIG. 1 whereby the recording head 110 conducts printing by ejecting ink, and that the carriage 120 in FIG. 2 moves to the position of the flushing portion 160 whereby the recording head 110 ejects the ink to the flushing portion 160 for the purpose of flushing.

Figure 4:
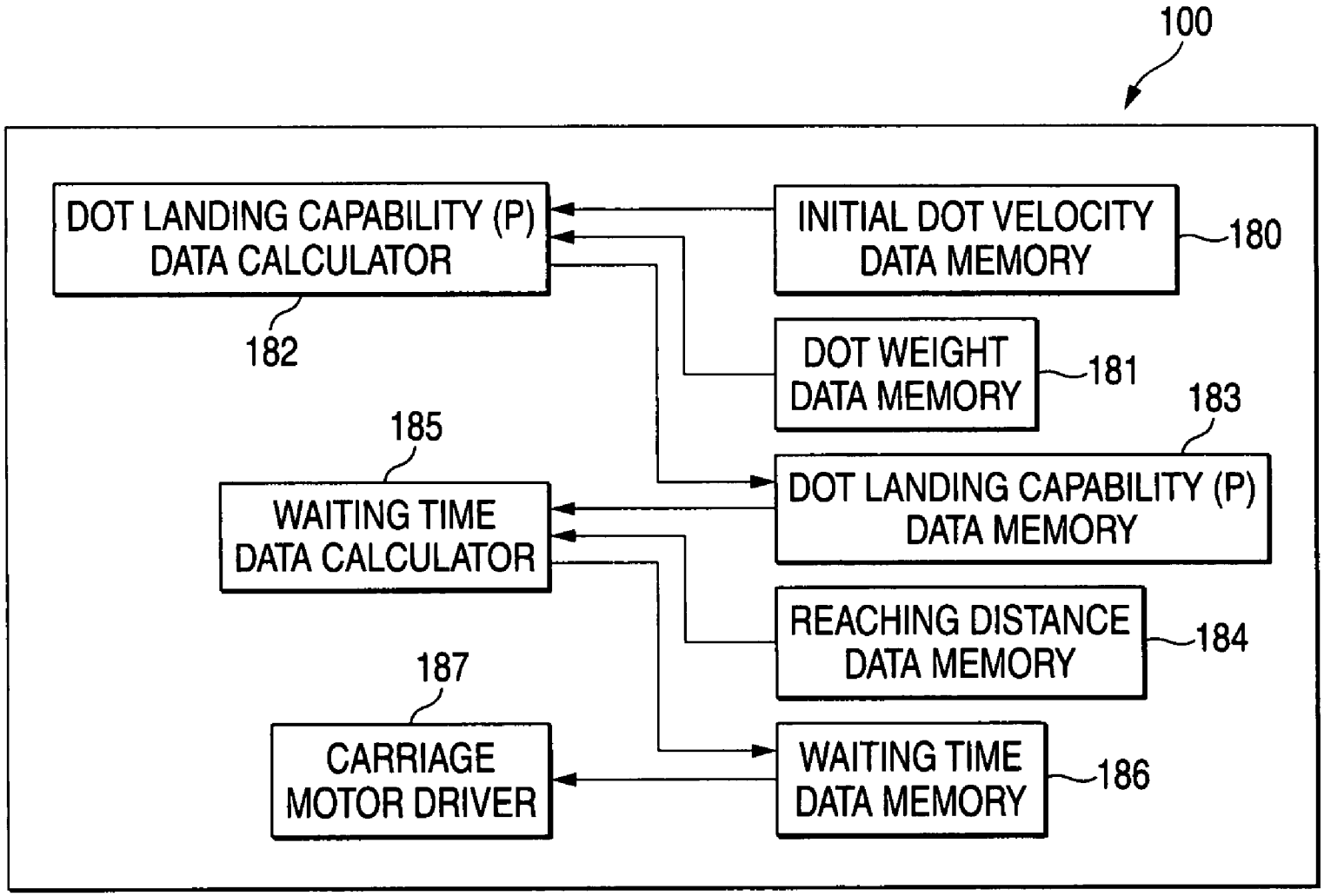
FIG. 4 is a schematic drawing showing the main software constitution of the recording apparatus in FIG. 3.

FIG. 4 is a schematic drawing showing the main software constitution of the recording apparatus 100 in FIG. 3. As shown in FIG. 4, the recording apparatus 100 has an initial dot velocity data memory 180 which stores the initial dot velocity data for the ink (one example of initial dot velocity information), which is an example of the velocity information when the ink is ejected from the recording head 110.

Here, the velocity information is an example of the estimation information to estimate the time required for the ink to reach the flushing portion 160.

In other words, the data on the initial velocity with which the ink is ejected from the recording head 110 arranged in the recording apparatus 100 is stored in the initial dot velocity data memory 180. Since this initial velocity data for ink varies from one recording head 110 to another, the data stored in the initial dot velocity data memory 180 are the initial ink velocity data specific for the recording head 110 installed in the recording apparatus 100.

Moreover, the recording apparatus 100 has a dot weight data memory 181 which stores the dot weight data (an example of dot weight information) for ink, which is an example of ink weight information (estimation information). This dot weight data varies depending on the kind of the ink accommodated in the ink cartridge 111 in FIG. 2. Thus, the data stored in the dot weight data memory 181 are the dot weight data specific for the ink in the ink cartridge 111 installed in the recording apparatus 100.

As shown in FIG. 4, the recording apparatus 100 has a dot landing capability (P) data calculator, which is an example of a liquid reaching capability information generator that generates dot landing capability (P) data, which is an example of liquid reaching capability information, based on the initial dot velocity data in the initial dot velocity data memory 180 and the dot weight data in the dot weight data memory 181.

The dot landing capability (P) data calculator 182 is so constituted as to calculate the dot landing capability (P) data by multiplying, for example, the initial dot velocity data with the dot weight data.

By calculating the dot landing capability (P) data in this manner, the recording apparatus is so constituted as to acquire the landing capability such as the velocity with which the ink dot ejected from the recording head 110 reaches the flushing portion 160.

The recording apparatus 100 has a dot landing capability (P) data memory 183 which stores the dot landing capability (P) data calculated by the dot landing capability (P) data calculator 182.

On the other hand, the recording apparatus 100 has a reaching distance data memory 184 which stores reaching distance data, which is an example of the information on the distance between the recording head 110 and the flushing portion 160 (estimation information).

Figure 5:
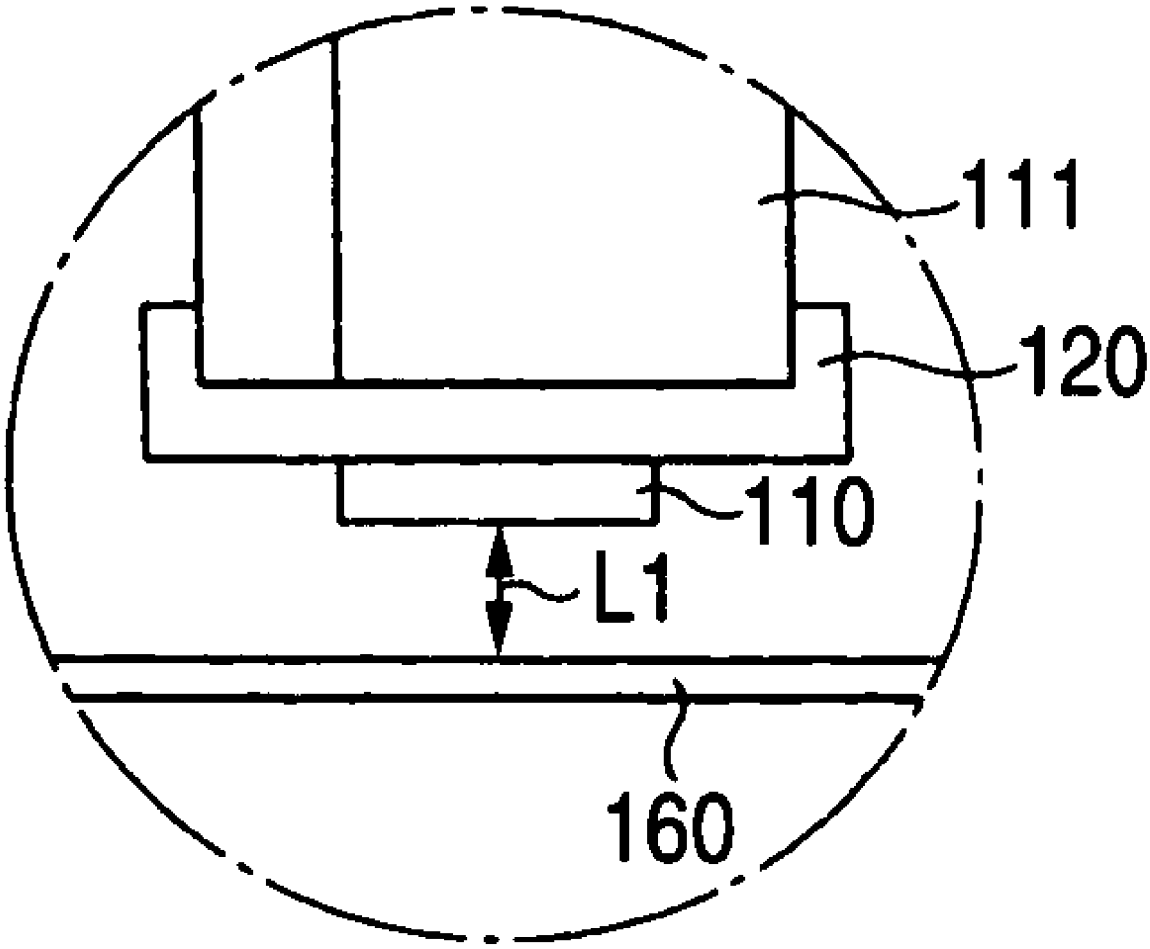
FIG. 5 is an outlined explanatory drawing showing the relationship of the recording head and the flushing portion both shown in FIG. 2.

FIG. 5 is an outlined explanatory drawing showing the relationship of the recording head 110 and the flushing portion 160 both shown in FIG. 2.

By using FIG. 5, the reaching distance data are described. Namely, the reaching distance data is the distance L1 between the recording head 110 and the flushing portion 160 in FIG. 5. This distance L1 is variously set depending on the object on which the recording apparatus 110 is conducting printing. Therefore, the distance L1, which is the reaching distance data to be stored in the reaching distance data memory 184 in FIG. 4 is specific for the recording apparatus 100.

The recording apparatus 100 has a waiting time data calculator 185, which is an example of the waiting time information generator to generate waiting time data, an example of waiting time information, based on the dot landing capability (P) data in the dot landing capability (P) data memory 183 and the reaching distance data in the reaching distance data memory 184.

In other words, since the waiting time data is determined based on the distance between the recording head 110 and the flushing portion 160 and the ink dot landing capability (P), the time required for the ink ejected from the recording head 110 to reach the flushing portion 160 is accurately estimated.

And the recording apparatus 100 has a waiting time data memory 186 to store the waiting time data calculated by the waiting time data calculator 185.

Furthermore, the recording apparatus 100 has a carriage motor driver 187 to drive the carriage motor 150 in FIG. 3. And the carriage motor driver 187 is so configured as to drive the carriage 120 based on the waiting time data in the waiting time data memory 186. The recording head 110 mounted on the carriage 120 is so configured as to move in synchronism with the movement of the carriage 120.

Accordingly, when the recording head 110 which has moved to the flushing portion 160 in FIG. 2 conducts a flushing operation of ejecting ink, the carriage motor driver 187 of the recording apparatus 100 is so configured as to move the recording head 110 to the printing region after the elapse of the time equal to the waiting time data in the waiting time data memory 186.

With such a configuration, the movement of the recording head 110 is performed after the ejected ink has reached (hit) the flushing portion 160 with certainty. Thus, the 'mist' generation caused by the movement of the recording head 110 prior to the ink dot reaching, as in conventional manner, can be prevented beforehand. And, by preventing 'mist' generation, the inside as well as the outside of the recording apparatus 100 can be prevented from contamination.

In the present embodiment, the waiting time data is determined for each of individual recording apparatuses based on the reaching distance data between the recording head 110 and the flushing portion 160 (the distance L1 in FIG. 5), the initial dot velocity data of the recording head and the dot weight data of the ink mounted in the recording apparatus 100 in concern.

Thus, since, compared with the case where the waiting time is indiscriminately determined regardless of each recording apparatus, useless waiting time can be avoided, deterioration of printing throughput can be prevented beforehand.

In the present embodiment, since initial dot velocity data, dot weight data, etc., all being readily available, are used as the bases for the calculation of the waiting time, the waiting time can be calculated via comparatively easy calculation. For that reason, without using a complicatedly configured apparatus, 'mist' generation during flushing operation can be prevented beforehand and deterioration of printing throughput can be prevented with a simple configuration.

Figure 6:
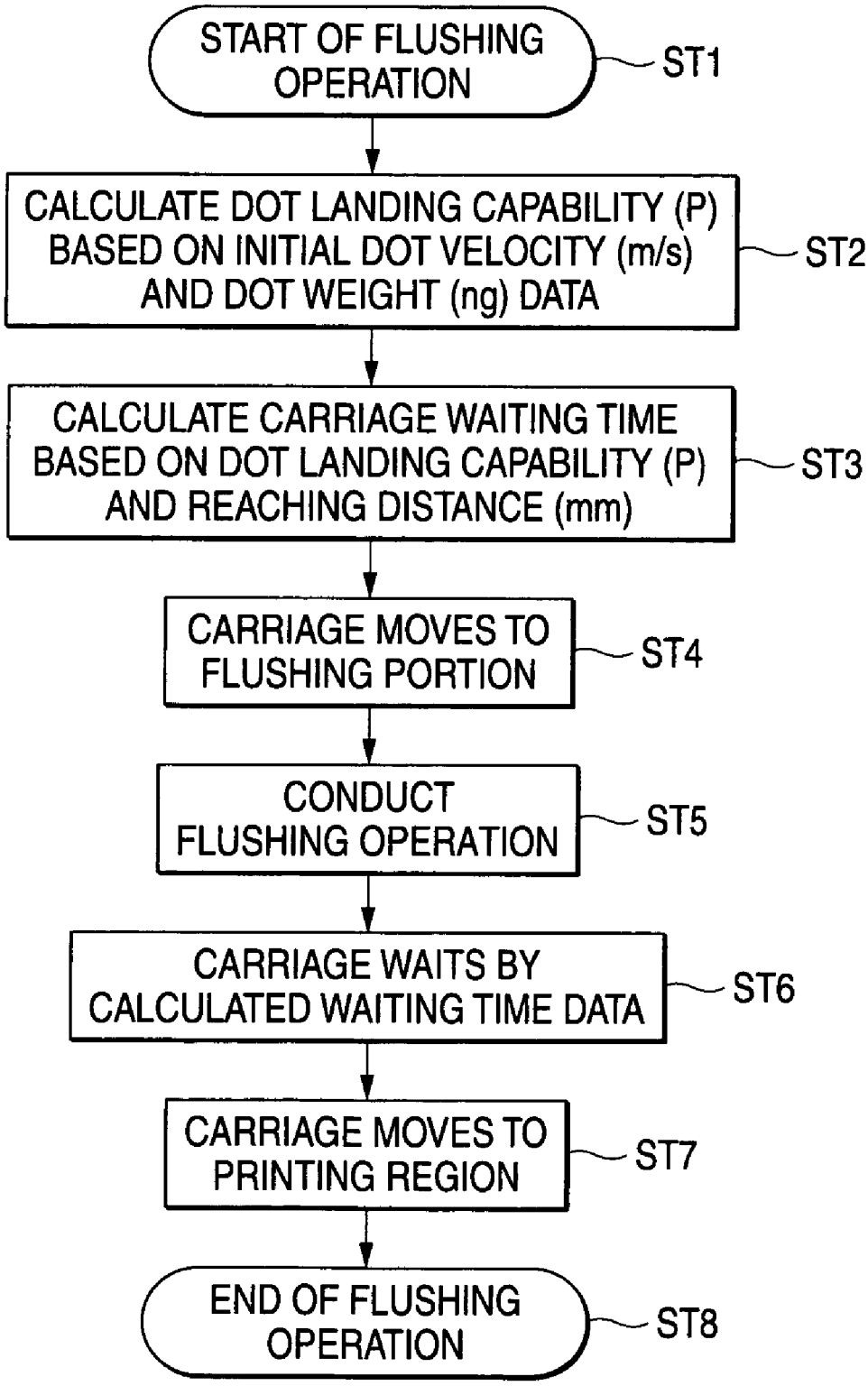
FIG. 6 is an outlined flowchart showing the flushing operation according to the embodiment.

FIG. 6 is an outlined flowchart showing the flushing operation associated with the present embodiment.

First of all, a flushing operation is initiated, as shown by ST1 in FIG. 6.

Next, the dot landing capability (P) data calculator 182 calculates dot landing capability (P) data based on initial dot velocity data and dot weight data (ST2) (an example of the process of forming liquid reaching capability information).

FIG. 7 is an example of data showing the calculation result of dot landing capability (P) data. In the present embodiment, a case where the initial dot velocity data is 1 to 20 m/s and the dot weight data is 10 ng or less is explained below.

If, here, the initial dot velocity of 2.5 m/s and the dot weight of 2.0 ng are assumed, the dot landing capability (P) data is equal to 5.0. This value '5.0', which represents the dot landing capability (P) data, is stored in the dot landing capability (P) data memory 183.

Then, as shown in ST3 in FIG. 6, the waiting time data calculator 185 calculates the waiting time data for the carriage 120 based on the dot landing capability (P) data and the reaching distance data (mm) which is the distance L1 in FIG. 5 (an example of the formation process for waiting time information).

Figure 8:
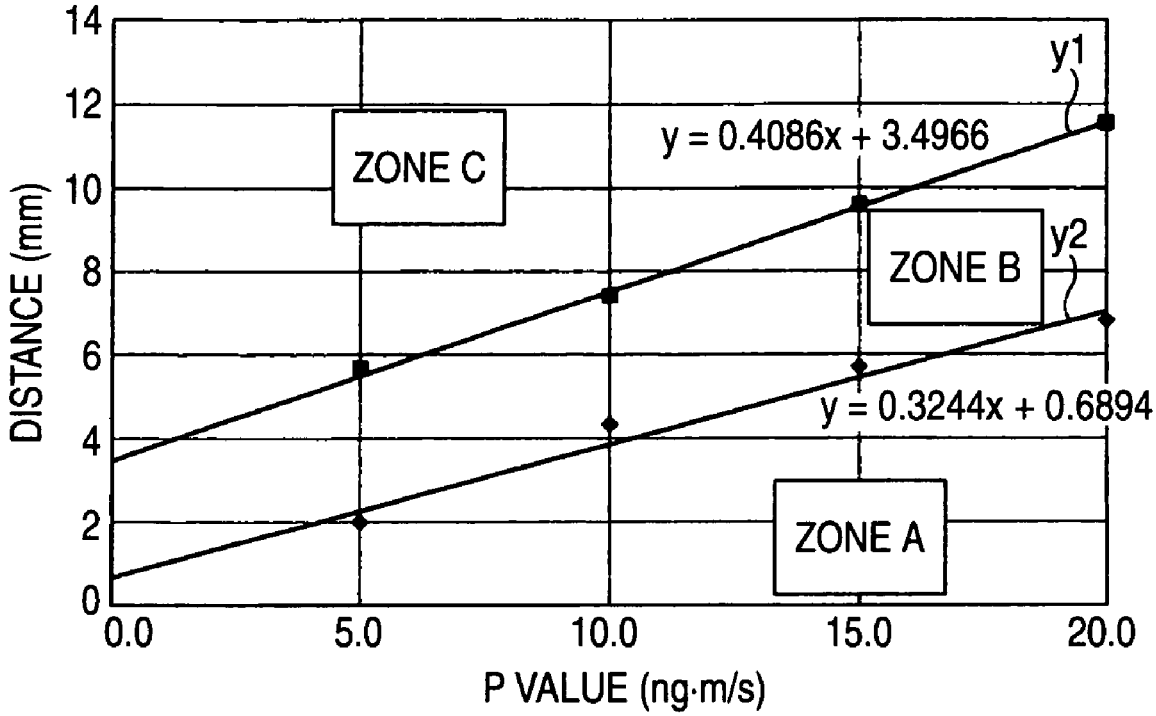
FIG. 8 is a graph showing an example of waiting time data calculation.
Figure 9:
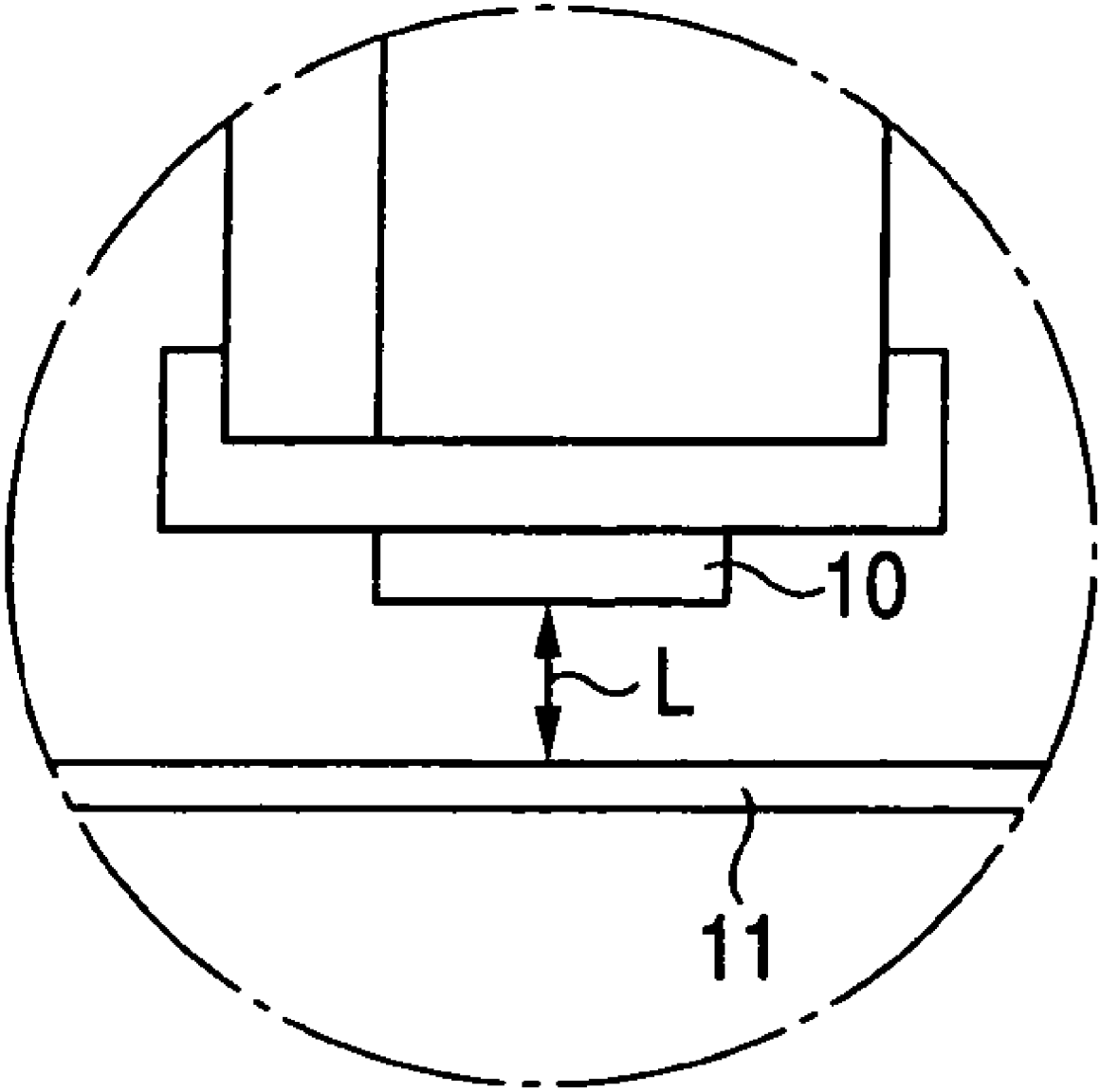
FIG. 9 is an outlined explanatory drawing showing the relation between a related art inkjet recording head and a flushing portion.

FIG. 8 is a graph showing an example of waiting time data calculation. As shown in FIG. 8, if the reaching distance data is assumed to be, for example, 2 mm, the cross-point of the dot landing capability (P) data of '5' with the reaching distance of '2 mm' is included in 'Zone A' which is the area beneath the line y1.

Zone A shows that the time required for a dot ejected from the recording head 110 to reach the flushing portion 160 is '100 ms'.

Accordingly, in the above-described example, the waiting time data becomes '100 ms'.

Then, the carriage 120 moves to the position of the flushing portion 160 in FIG. 2 (ST4). Specifically, the recording head 110, which has been conducting printing on recording paper K at the printing region moves to a position above the flushing portion 160 by the movement of the carriage 120.

Next, a flushing operation in which the recording head 110 ejects ink onto the flushing portion 160 is conducted (ST5).

Then, the carriage driver 187 moves the carriage 120 mounting the recording head 110 to the printing region where recording paper K in FIG. 2 is arranged after waiting for '100 ms' following the flushing of the recording head 110 (ST7) (an example of the process for liquid ejection head movement).

In this way, the flushing operation terminates.

By virtue of conducting a flushing operation in this way, it becomes possible to prevent not only mist generation but also printing throughput deterioration.

Meanwhile, in FIG. 8, when the cross-point of the dot landing capability (P) with the reaching distance in mm is involved in 'Zone B' which occupies the area between lines y2 and y1, the waiting time data becomes '500 ms'. When the cross-point of the dot landing capability (P) with the reaching distance in mm is involved in the area lying above line y2, that area is 'Zone C', and the waiting time data becomes 'longer than 500 ms'

In this way, the apparatus is so configured as to be able to effectively save useless waiting time, since the waiting time data can be varied depending on the various dot landing capability (P) data and the reaching distance in mm, both of which are different for each recording apparatus.

OTHER EMBODIMENTS

The recording apparatus 100 associated with the above-described embodiment established the waiting time by using three kinds of data, i.e., the data of ink dot weight, the initial dot velocity data, and the reaching distance data. But, the scope of the invention is not limited to the above constitution, but the apparatus may be configured as follows, too.

For example, the waiting time may be established only based on the velocity data such as initial dot velocity.

Namely, if the initial velocity of ink is small, it takes a long time for the ink to reach the flushing portion 160, while, inversely, if the velocity is large, the time becomes short. In other words, the waiting time until ink reaches the flushing portion 160 can be estimated by setting the waiting time based on the initial dot velocity data.

Further, the waiting time may be established only based on the data on ink dot weight.

Namely, the smaller the ink dot weight is, the velocity with which the ink reaches the flushing portion 160 is likely to drop, whereby it takes a long time to reach there. In other words, by establishing the waiting time based on the data on ink dot weight, the waiting time until the ink reaches the flushing portion 160 can be estimated. And, since, during this waiting time, the recording head 110 is not allowed to move, mist diffusion can be favorably prevented.

In addition, since, in this case, the information to be processed is merely the dot weight data, the information is readily available, requiring just a short time for setting, and the processing can be conducted rapidly.

Alternatively, the waiting time may be established only based on the data on distance information such as reaching distance data. Namely, the longer the distance between the recording head 110 and the flushing portion 160 is, it takes a long time for the ink to reach the flushing portion 160.

Namely, the waiting time until the ink reaches the flushing portion 160 can be estimated by setting the waiting time based on the reaching distance data between the recording head 110 and the flushing portion 160.

In the following, an example is shown in which the waiting time can be estimated only from the reaching distance data. In the case where, in a recording apparatus such as a printer using dot weight data or initial dot velocity data, these data are regarded as fixed values without variation, then the dot landing capability data also becomes a fixed value whereby ST2 in FIG. 6 is not necessary.

In this case, the waiting time can be set only based on the reaching distance data.

By the way, the waiting time can be estimated based on data other than those on ink dot weight, initial dot velocity and reaching distance.

Specifically, the accumulated printing time information (accumulated printing time data) obtained by accumulating the printing time during which the recording head 110 ejects ink towards recording paper K, or liquid species information (liquid species data) related to specific gravity and viscosity. By way of precaution, these kinds of information are examples of estimation information.

First of all, the case where waiting time setting based only on accumulated printing time data is described.

Accumulated printing time data is one obtained by accumulating the printing time during which the recording head 110 operates, and the longer the accumulated printing time becomes, the more the ink in the nozzle gradually increases its viscosity. For the case where the ejection energy for the ink ejected from the nozzle is the same, the velocity becomes slow since a viscosity-increased ink becomes difficult to fly.

For example, in the case where the accumulated printing time is 0 to 1 hr with an initial dot velocity of 5.0 m/s, the initial dot velocity decreases to 4 m/s in 1 to 2 hr, and further to 3 m/s for the case of 2 hr or more.

Hence, with the increase of accumulated printing time, the time required for the ink to reach the flushing portion 160 is extended.

In other words, by setting the waiting time based on the accumulated printing time obtained by accumulating the printing time during which the recording head 110 ejects ink towards the recording paper K, the waiting time until ink reaches the flushing portion 160 can be estimated.

Next, waiting time setting only based on liquid species information is explained.

It has already been pointed out that the dot weight data varies depending on ink species, but in addition to that, dot weight data and initial dot velocity data also vary depending on ink specific gravity as well as viscosity. Liquid species data are mainly those related to the specific gravity as well as viscosity of ink.

Specifically, a change in ink specific gravity influences dot weight data, while a change in ink viscosity influences initial dot velocity. Namely, dot landing capability results in a change depending on ink species, which is an example of liquid species data, thus influencing the waiting time.

In other words, by setting the waiting time based on liquid species information related to ink specific gravity as well as viscosity, the waiting time until the ink reaches the flushing portion 160 can be estimated.

In such a manner, since, in cases where the waiting time is estimated by using only each of ink dot weight data, initial dot velocity data, reaching distance data, accumulated printing time data, and liquid species data, respectively, the recording head 110 is not moved within this estimated waiting time, mist diffusion can be preferably prevented.

In addition, in these cases, the information to be treated is a singular data such as dot weight data, information is readily available, not taking long time for setting, and can be processed rapidly.

Meanwhile, as explained heretofore, the examples of estimating the waiting time by using only each of ink dot weight data, initial dot velocity data, reaching distance data, accumulated printing time data, and liquid species data, respectively have been described. But, the scope of the invention is not limited thereto, but the waiting time may also be estimated based on the combination information obtained by combining a plurality of these, whereby a more accurate waiting time can be estimated.

The invention is not restricted to the above-described embodiments. Moreover, the invention, which is not limited to inkjet recording apparatuses, can be applied to a recording head used for an image-recording apparatus such as a printer, a coloring agent ejection head used for the manufacture of color filters for a liquid crystal display, an electrode material ejection head used for the formation of electrodes in an organic EL display and an FED (a flat light-emitting display), a liquid ejection apparatus using a liquid ejection head, which ejects a liquid such as a biotic organic matter used for bio-chip manufacture, and a sample ejection apparatus as a high-precision pipette.

What is claimed is:

1. A liquid ejection apparatus comprising:

a liquid ejection head, operable to eject liquid to a target;

a printing region, at which the liquid ejection head ejects liquid to the target;

a flushing region, at which the liquid ejection head ejects liquid to perform a flushing operation;

a flushing receiver, provided at the flushing region and adapted to receive liquid ejected from the liquid ejection head at the flushing region;

a liquid ejection head carrier, operable to carry the liquid ejection head at least between the printing region and the flushing region;

a waiting time information generator, operable to calculate a waiting time based on estimation information to estimate a time in which liquid ejected from the liquid ejection head arrives at the flushing receiver; and a controller, operable to control the liquid ejection head carrier to carry the liquid ejection head from the flushing region toward the printing region after the waiting time elapses.

2. The liquid ejection apparatus according to claim 1, wherein the estimation information is information indicative of velocity of liquid ejected from the liquid ejection head.

3. The liquid ejection apparatus according to claim 1, wherein the estimation information is information indicative of weight of liquid ejected form the liquid ejection head.

4. The liquid ejection apparatus according to claim 1, wherein the estimation information is information indicative of length between the liquid ejection head and the flushing receiver.

5. The liquid ejection apparatus according to claim 1, wherein the estimation information is information indicative of an accumulated printing time obtained by accumulating printing time during which the liquid ejection head ejects liquid toward the target.

6. The liquid ejection apparatus according to claim 1, wherein the estimation information is information indicative of liquid species including at least one of specific gravity and viscosity.

7. The liquid ejection apparatus according to claim 1, wherein the estimation information includes at least two information selected from a group consisting of: information indicative of velocity of liquid ejected from the liquid ejection head; information indicative of weight of liquid ejected form the liquid ejection head; information indicative of length between the liquid ejection head and the flushing receiver; information indicative of an accumulated printing time obtained by accumulating printing time during which the liquid ejection head ejects liquid toward the target; and information indicative of liquid species including at least one of specific gravity and viscosity.

8. The liquid ejection apparatus according to claim 1, further comprising: a liquid reaching capability information generator, operable to generate liquid reaching capability information based on information indicative of velocity of liquid ejected from the liquid ejection head and information indicative of weight of the liquid, wherein the waiting time information generator generates a waiting time based on information indicative of length between the liquid ejection head and the flushing receiver and the liquid reaching capability information.

9. The liquid ejection apparatus according to claim 2, wherein the velocity is an initial velocity of dot of the liquid.

10. The liquid ejection apparatus according to claim 3, wherein the weight is a weight the liquid for forming a dot on the target.

* * * * *